US008485150B2

(12) United States Patent
Schafer et al.

(10) Patent No.: US 8,485,150 B2
(45) Date of Patent: Jul. 16, 2013

(54) GROUP OF MULTIPLE CAMSHAFTS WITH CAMSHAFT ADJUSTERS

(75) Inventors: Jens Schafer, Herzogenaurach (DE); Mike Kohrs, Wilthen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 1132 days.

(21) Appl. No.: 12/374,132

(22) PCT Filed: Jun. 29, 2007

(86) PCT No.: PCT/EP2007/056567
§ 371 (c)(1),
(2), (4) Date: Apr. 10, 2009

(87) PCT Pub. No.: WO2008/009548
PCT Pub. Date: Jan. 24, 2008

(65) Prior Publication Data

US 2009/0312109 A1 Dec. 17, 2009

(30) Foreign Application Priority Data

Jul. 19, 2006 (DE) ..... 10 2006 033 425

(51) Int. Cl.
*F01L 1/34* (2006.01)

(52) U.S. Cl.
USPC ..... 123/90.17; 464/160

(58) Field of Classification Search
USPC ..... 123/90.15, 90.17, 90.6; 464/160
See application file for complete search history.

(56) References Cited

U.S. PATENT DOCUMENTS

| | | | | |
|---|---|---|---|---|
| 5,934,233 | A * | 8/1999 | Auchter et al. | 123/90.17 |
| 6,182,623 | B1 * | 2/2001 | Sugie et al. | 123/90.17 |
| 6,502,537 | B2 * | 1/2003 | Todo et al. | 123/90.17 |
| 6,732,688 | B2 * | 5/2004 | Yamamuro et al. | 123/90.17 |
| 6,920,854 | B2 * | 7/2005 | Komaki | 123/90.17 |
| 6,945,205 | B2 * | 9/2005 | Heintzen et al. | 123/90.17 |
| 6,994,062 | B2 * | 2/2006 | Kawai et al. | 123/90.15 |
| 7,131,409 | B2 * | 11/2006 | Tanno et al. | 123/90.17 |
| 7,228,830 | B2 * | 6/2007 | Watanabe | 123/90.17 |
| 7,503,294 | B2 * | 3/2009 | Ogawa et al. | 123/90.16 |
| 2002/0100444 | A1 * | 8/2002 | Todo et al. | 123/90.17 |
| 2005/0061277 | A1 | 3/2005 | Takenaka et al. | |
| 2007/0245990 | A1 * | 10/2007 | Hentschel et al. | 123/90.17 |

FOREIGN PATENT DOCUMENTS

| | | |
|---|---|---|
| DE | 3929619 | 3/1991 |
| DE | 4110195 | 10/1992 |
| DE | 4415524 | 11/1994 |
| DE | 19611365 | 9/1997 |
| DE | 19848706 | 4/2000 |
| DE | 19860388 | 6/2000 |
| DE | 10038354 | 2/2002 |
| DE | 10205034 | 8/2003 |
| DE | 10224446 | 12/2003 |
| DE | 10317601 | 12/2003 |
| DE | 10248355 | 4/2004 |
| DE | 102004024221 | 3/2005 |
| DE | 102004024222 | 3/2005 |
| DE | 102004062069 | 7/2006 |
| EP | 0356162 | 3/1993 |
| EP | 1043482 | 10/2003 |
| WO | 03098010 | 11/2003 |

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

Groups of camshafts (6) are connected to camshaft adjusters (1) via adapters. According to prior art, adaptations to the camshaft adjuster (1) are necessary for different mounting conditions and/or different geometries of camshafts (6). Here, an adapter (32) is provided between camshaft (6) and camshaft adjuster (1), which adapter can then be adapted to different geometries of the camshaft (6) and/or mounting positions. By this, the multiplicity of parts can be reduced.

14 Claims, 14 Drawing Sheets

GROUP OF MULTIPLE CAMSHAFTS WITH CAMSHAFT ADJUSTERS

BACKGROUND

The invention relates to a group of several camshafts that are each in driven connection with a camshaft adjuster.

Camshaft adjusters can be roughly classified, in principle, as follows:

A. Phase adjusters with a control element, that is, a functional unit that engages in the flow of mass or energy and that is constructed, for example, hydraulically, electrically, or mechanically and that rotates with gear elements of the camshaft adjuster.

B. Phase adjusters with a separate controller, that is, a functional unit in which the control parameter required for controlling the control element is formed from controller output parameters and with a separate control element. Here, there are the following configurations:

a. Phase adjusters with a co-rotating actuator and a co-rotating control element, for example, a speed-increasing gearbox whose adjustment shaft can be preset by a co-rotating hydraulic motor or centrifugal force motor and can be reset by a spring.

b. Phase adjusters with a co-rotating control element and a stationary, motor-fixed actuator, for example, an electric motor or an electric or mechanical brake, see also DE 100 38 354 A1, DE 102 06 034 A1, EP 1 043 482 B1.

c. Phase adjusters with a direction-dependent combination of solutions according to a. and b., for example, a motor-fixed brake in which a part of the brake power is used for an advanced adjustment, in order to tension a spring that allows readjustment after the brake is deactivated, see also DE 102 24 446 A1, WO 03-098010, US 2003 0226534, DE 103 17 607 A1.

In systems according to B.a. to B.c., actuators and control elements are connected to each other by an adjustment shaft. The connection can be switchable or non-switchable, detachable or non-detachable, with or without play, and elastic or stiff. Independent of the configuration, the adjustment energy can be realized in the form of a provision of drive power and/or brake power as well as the use of stray power of the shaft system (e.g., friction) and/or inertia and/or centrifugal forces. Braking, advantageously in the "retarded" adjustment direction can also be realized under complete use or joint use of the friction power of the camshaft. A camshaft adjuster can be equipped with or without mechanical limiting of the adjustment region. One-stage or multiple-stage triple-shaft gearboxes and/or multiple linkages or coupling gearboxes are used as gearboxes in a camshaft adjuster, for example, in a configuration as a swashplate gearbox, eccentric gearbox, planetary gearbox, harmonic drive, cam-disk gearbox, multiple linkage or coupling gearbox, or combinations of the individual configurations for a multiple-stage construction.

While conventional, hydraulically activated camshaft adjusters or camshaft adjusters in a configuration with vane cells, pivot vanes, or segmented vanes have the advantage that the hydraulic medium for control can be fed at any position in the camshaft adjuster, the hydraulic medium can be forwarded in the camshaft adjuster via suitable flow channels, the hydraulic medium—if required—can be redirected, and suitable devices for controlling the hydraulic pressure can also have a decentralized arrangement from the camshaft adjuster, in conventional camshaft adjusters in which the control movement is generated by an electric motor and a super-position gearbox, triple shaft gearbox, or planetary gearbox (below, super-position gearbox), see, for example, DE 41 10 195 A1, the electric motor is typically arranged flush to the longitudinal axis of the camshaft and the super-position gearbox in front of the super-position gearbox. The control assemblies responsible for generating the control movement of a camshaft adjuster can be used as a brake and also as a motor. The use of a hydraulic valve for generating the control movement in which a magnet must be arranged for activation in the centered position is also possible.

For a rotationally fixed connection between a connection element of the camshaft adjuster and the camshaft, e.g., a central screw can be used that extends through a passage borehole of the connection element and is screwed on the front end into an axially oriented thread of the camshaft, so that the connection element is tightened with the camshaft, see, e.g., DE 100 38 354 C2, DE 102 48 355 A1, EP 0 356 162 B1, an end-side flange of the camshaft can be screwed eccentrically with a counter flange of the connection element, see, e.g., DE 44 15 524, DE 196 11 365 C2, a multifunctional connection element can be screwed directly into a front-side borehole of the camshaft, cf. DE 198 48 706 A1.

SUMMARY

The present invention is based on the objective of providing a connection between a camshaft and a camshaft adjuster that reduces the multiplicity of components for a group of camshafts with associated camshaft adjusters with different installation conditions.

According to the invention, the objective is met by the features of the independent Claims 1 or 2. Other configurations of the invention emerge accordingly from the features of the dependent Claims 3 to 13.

The present invention involves the knowledge that despite the fact that a camshaft adjuster of a given configuration can be used for different conditions of use, in particular, in internal combustion engines, without requiring significant adaptations of the configuration of the camshaft adjuster, different variants of the camshaft adjuster must be produced, delivered, and assembled according to the predominant connection conditions. In addition to an increased production effort, increased production costs, increased logistics requirements, as well as increased construction and development effort, this leads to increased assembly effort, because for the corresponding connection conditions, a camshaft adjuster must be selected from a plurality of different camshaft adjusters.

According to the invention, a group is provided with components that are each formed with a camshaft and an associated camshaft adjuster. Within the group named above there are at least two sub-groups, wherein in a component of one sub-group relative to a component of another sub-group, for structurally identical connection elements of the camshaft adjuster, the camshafts have different geometries and/or different installation situations. Adaptation requirements produced by the different geometries of the camshaft and/or the different installation situations are not equalized by different connection elements of the camshaft adjuster, but instead an adapter is used according to the invention between the connection element and the camshaft, wherein this adapter takes into account the differences explained above. In this way, according to the invention it is possible that for the different sub-groups, the same camshaft adjusters can be used, while different adapters are allocated to the sub-groups. In the extreme case, this can mean that one adapter is used for one sub-group, while no adapter is used for another sub-group, so that, for the construction of the wording of the independent claim, for one sub-group the adapter is a "nullity." Through the measures according to the invention, the portion of identical parts can be increased for the group. The adapter takes over, e.g., axial compensation according to the invention. The use of an adapter that equalizes a radial offset, for example, by a gearbox stage is also conceivable and a cumulative axial and radial compensation by the adapter is also possible. It is further possible that camshafts of the same or different construction are connected by the adapter to camshaft adjusters of the same or different construction, for example, an exhaust camshaft with an electrically activated camshaft adjuster and an intake camshaft with a hydraulic camshaft adjuster.

In one alternative solution according to the invention, identical camshafts with different camshaft adjusters and connection elements of the same can be connected accordingly by an adapter.

For a refinement according to the invention, a direct support of at least one camshaft and the associated connection element of the camshaft adjuster is realized by centering surfaces one against the other. For example, the centering surfaces can fix the position of the camshaft adjuster or the connection element relative to the camshaft in the radial direction, wherein this is possible in different axial positions. The axial position actually active for the sub-group is then given by the adapter. In this way, among other things, the production accuracies for the adapter can be reduced, because this does not have to ensure that through the exact setting of the relationship of the contact surfaces of the adapter with the camshaft on one side and its contact surfaces with the connection element on the other side, an aligned arrangement is guaranteed between the camshaft adjuster and camshaft. In addition to the setting of the radial position, a setting of an orientation, in particular, an alignment of the longitudinal axes of the camshaft and connection element, is possible in different axial positions for different sub-groups. Also conceivable is a centering by the use of an auxiliary tool.

In addition to the functions named above, the adapter can take over additional functions. According to a first configuration, a flow channel is defined with the adapter. Such a flow channel can involve a flow channel running in the interior of the adapter, by which a transfer of a flow medium from the camshaft to the adapter and also a forwarding of the flow medium in the region of a front-end contact surface between the adapter and connection element is realized, for example, in the region of a front-end contact. It is further possible that a flow channel is formed together by an outer surface or inner surface of the adapter and also an inner surface or outer surface of the connection element or the camshaft. In particular, grooves of the adapter, the camshaft, and/or the connection element expanding in cross section form the flow channel.

It is possible that different adapters can provide compensation for different requirements to an interface due to different camshafts and/or camshaft adjusters, for example, with respect to the flow conditions and/or, optionally, a transmission of electrical signals. In the extreme case, an adapter can allow a connection of a camshaft adjuster on a hydraulic basis with the associated channels, throttles, branching points, transition cross sections, and the like for the flow medium, while another adapter allows the connection of a camshaft adjuster with an electrical control assembly, wherein electrical interfaces and transmissions can also be allowed by the adapter.

Another construction according to the invention is provided in that, for example, in the region of a lateral surface or a front end of the adapter, a flow medium is transferred from an adjacent component, for example, a cylinder head, wherein a surrounding region for the flow medium transfer is sealed with a sealing element that allows a relative movement between the adapter and the adjacent component. Furthermore, an annular groove can be provided on the adapter and/or the adjacent component, in order to allow a transfer of a flow medium for each rotational angle of the adapter.

Advantageously, the configuration according to the invention is applied under the use of adapters for a connection of camshafts and connection elements by a central screw. In one such case, the adapter can be penetrated axially by the central screw, so that when the central screw is screwed into the camshaft, the connection element and the adapter can be tensioned axially one behind the other between a front end of the camshaft and a head of the central screw. Here, a transmission of a drive movement in the peripheral direction can be realized by a positive-fit connection between the camshaft, connection element, and adapter. The use of central screws of identical or different lengths is conceivable for the different sub-groups.

The sub-groups explained above can relate to camshafts and camshaft adjusters for different internal combustion engines. According to another configuration of the invention, different sub-groups relate to different cylinder banks of the same internal combustion engine. For example, for V-engines, under some circumstances, a right and a left cylinder bank can be naturally arranged offset relative to each other. Such an offset can be compensated by the use of an adapter.

Alternatively or additionally, by use of the adapter a different distance between a first camshaft bearing and a position of a chain track for different sub-groups can be compensated.

For the case that camshaft adjusters of basically matching construction are to be used in the sub-groups in which, however, the camshaft adjusters can have different set, defined operating positions, additional, different positioning elements can be used in the sub-groups. For example, in the sub-groups, different center positions can be desired for the camshaft adjusters and/or different end stops. In this case, the camshaft adjusters can be built and shaped basically identically. However, for setting an end position or a center position in the camshaft adjusters, different stops or structural elements are used for the force relationships for setting a center position.

According to another embodiment of the invention, the adapter can take over another function in that, in this adapter, a rotational angle transmitter is integrated as an integral component or as a component carried by the adapter. Such a rotational angle transmitter can detect, for example, a rotational angle, an angular velocity, and/or acceleration. It is conceivable that the different adapters of several sub-groups are each constructed with such a rotational angle transmitter or else only the adapter of one sub-group. Such a rotational angle transmitter can involve a trigger wheel or the like. Through possible displacement of such a rotational angle transmitter, for example, from a camshaft to the adapter, the production of the camshaft can be simplified. The output signals of the rotational angle transmitter can be taken into account in motor management, control strategy, and/or software design. According to the invention, within the sub-groups an adapter with different rotational angle transmitters can be used, for example, a rotational angle transmitter with a so-called "four finger wheel" and a "half-moon construction," without which changes to the camshaft and/or to the camshaft adjuster must be performed.

For the case that a rotary connection for a flow medium is provided between a cylinder head and the adapter by the adapter, which can be used for controlling the control assembly of the camshaft adjuster and/or a lubricant supply, under some circumstances, a corresponding complicated processing of the camshaft for guaranteeing a transfer of the flow medium can be eliminated. A residual risk due to residue found in the camshaft especially due to complicated boring patterns, because these patterns often include blind holds and crossings, is eliminated. In particular, for this purpose passage holes that can be operated open or closed on one side can be formed in an adapter. Through the combination of such passage holes with front-end grooves, complicated channel layouts can be produced in a relatively simple way. For this purpose, front end or lateral surfaces of flange surfaces of the camshaft and the connection element can be selectively included.

According to another construction, in one internal combustion engine or a family of internal combustion engines, catch mechanisms, fail-safe locks, restoring mechanisms, spring mechanisms, or other fail-safe mechanisms to be used that are expanded on the connection element in a modular way are included selectively through inclusion with different adapters simply in the camshaft drive between the connection element and the camshaft.

Through the construction according to the invention it is also possible that at least in the adapter of one sub-group, catches for additional assemblies driven by the camshaft drive are integrated.

The adapter to be used according to the invention can take over another function in that, in this adapter, decoupling elements are integrated, in particular, as an integral component or through construction of the adapter as a multiple-part component. One such decoupling element involves, for example, a spring element, a damping element, or a combined spring-damping element.

According to an improvement according to the invention, support in a bearing for supporting the camshaft is realized by the adapter. For example, a first main bearing of the camshaft is formed in this way with the adapter.

The invention further proposes that the adapter can be connected to a restoring spring. Such a restoring spring that acts directly or indirectly between the rotor and stator is used for influencing the forces or moment relationships in the camshaft adjuster, wherein the restoring spring allocated to the adapter can also be used for a restoring spring arranged in the camshaft adjuster or as a single restoring spring. Through the selection of a restoring spring supported on the adapter, for example, the same camshaft adjusters can be used with modified characteristics for different cases of use.

It is also possible that add-on assemblies, such as, for example, a pump or the like, are connected by the adapter.

Advantageous improvements of the invention emerge from the claims, the description, and the drawings. The advantages of features and combinations of several features named in the introduction are merely examples, without these necessarily having to be achieved by the embodiments according to the invention. Other features are taken from the drawings—in particular, the shown geometries and the relative dimensions of several components to each other and also their relative arrangement and active connection. The combination of features of different embodiments of the invention or of features of different claims is also possible deviating from the selected associations and is herewith suggested. This also relates to those features that are shown in separate drawings or that are named in their description. These features can also be combined with features of different claims. Likewise, features listed in the claims can also be left out for other embodiments of the invention.

BRIEF DESCRIPTION OF THE DRAWINGS

Other features of the invention emerge from the following description and the associated drawings in which embodiments of the invention are shown schematically. Shown are.

DETAILED DESCRIPTION OF THE PREFERRED EMBODIMENTS

In the figures there are components that are provided partially with the same reference symbols with respect to their shape and/or function. FIGS. 1 to 4 show example configurations for the active connections of a control assembly, a camshaft adjuster, and a camshaft according to state of the art, without having to limit the invention to these basic embodiments.

Figure 1:
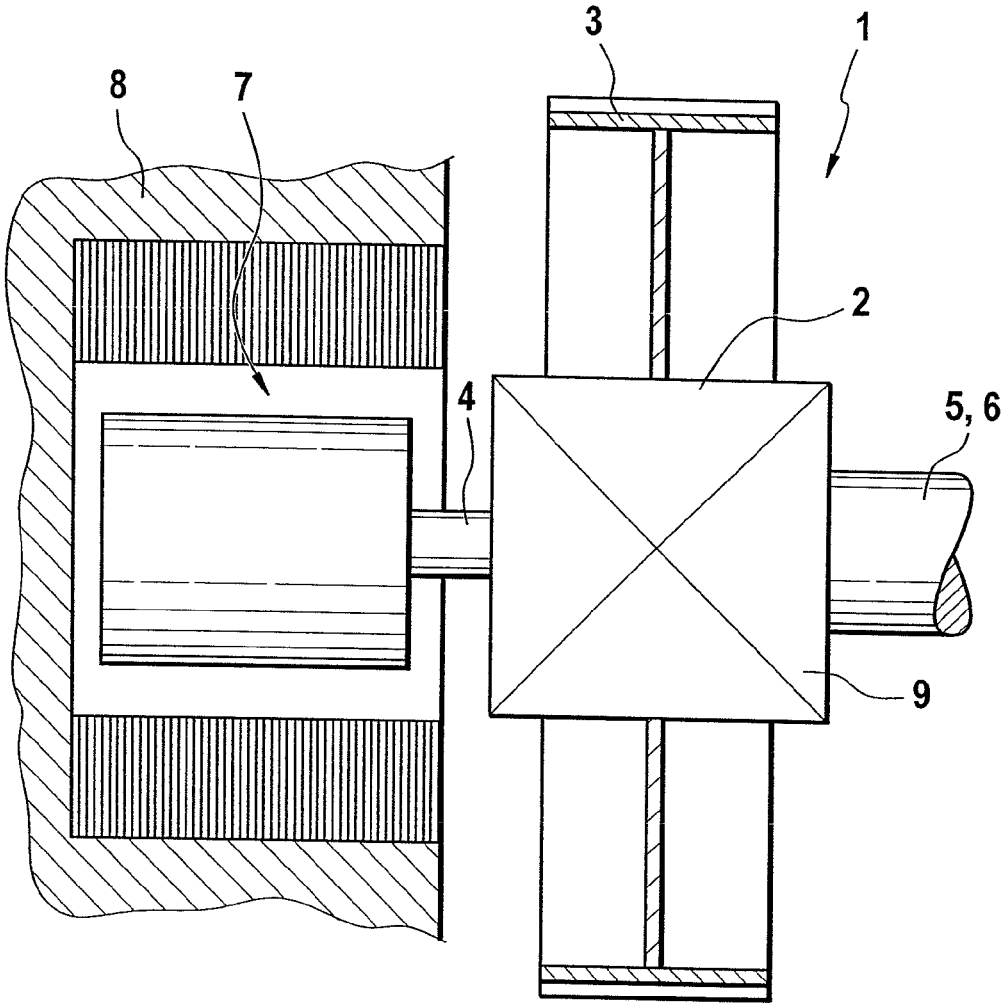
FIG. 1 a schematic diagram of a camshaft adjuster according to the state of the art in which an electrical control assembly is arranged on the side of a super-position gearbox facing away from the camshaft, FIG. 2 a longitudinal section view of an example configuration of a camshaft adjuster with a swashplate gearbox according to the state of the art, FIG. 3 a schematic view of a drive connection with an electrical control assembly that is arranged on the side facing away from the camshaft and that is connected by a control shaft to a cross bar or an intermediate element of the super-position gearbox according to the state of the art, FIG. 4 a view of a drive connection in which an electrical control assembly is arranged radially outside of the camshaft and the add-on assembly is arranged on the side facing away from the camshaft according to the state of the art, FIG. 5 a view of a camshaft adjuster with connection measures of a connection element that can be connected according to the invention through the use of different adapters for several sub-groups with camshafts of different geometries and/or installation situations, FIG. 6 a view of a connection of the camshaft adjuster according to FIG. 5 in a first sub-group with a first adapter and a camshaft with a first geometry, FIG. 7 a view of a connection of the camshaft adjuster according to FIG. 5 in a second sub-group with a second adapter and a camshaft with a second geometry, FIG. 8 a view of a connection of the camshaft adjuster according to FIG. 5 in a third sub-group with a third adapter and a camshaft with a third geometry, FIGS. 9, 10 a view showing the installation situations for a right and a left cylinder bank of a V engine with compensation through the use of an adapter, FIG. 11 a view of a sub-group with a camshaft adjuster connected by an adapter to a camshaft in which the adapter is constructed as a rotary connection for a flow medium and completely or partially defines flow channels, FIGS. 12, 13 a view of an adaptation of an adjustment region of a camshaft adjuster through the use of a stop ring, FIG. 14 a view of an intermediate connection of an adapter with spring-mounted and/or damping properties between a camshaft and a camshaft adjuster.

FIG. 1 shows in schematic representation a camshaft adjuster 1 in which, in a super-position gearbox 2, the movement of two input elements, here a drive gear 3 and an adjustment shaft 4, is superimposed on an output movement of an output element, here a drive shaft 5 connected locked in rotation with a camshaft or the camshaft 6 directly. The drive gear 3 is in drive connection with a crankshaft of the internal combustion engine, for example, via a traction mechanism, such as a chain or a belt or suitable teeth, wherein the drive gear 3 could be constructed as a chain or belt wheel.

The adjustment shaft 4 is driven by an electrical control assembly 7 or is in active connection with a brake. The electrical control assembly 7 is supported relative to the surroundings, for example, the cylinder head 8 or another engine-fixed part.

Figure 2:
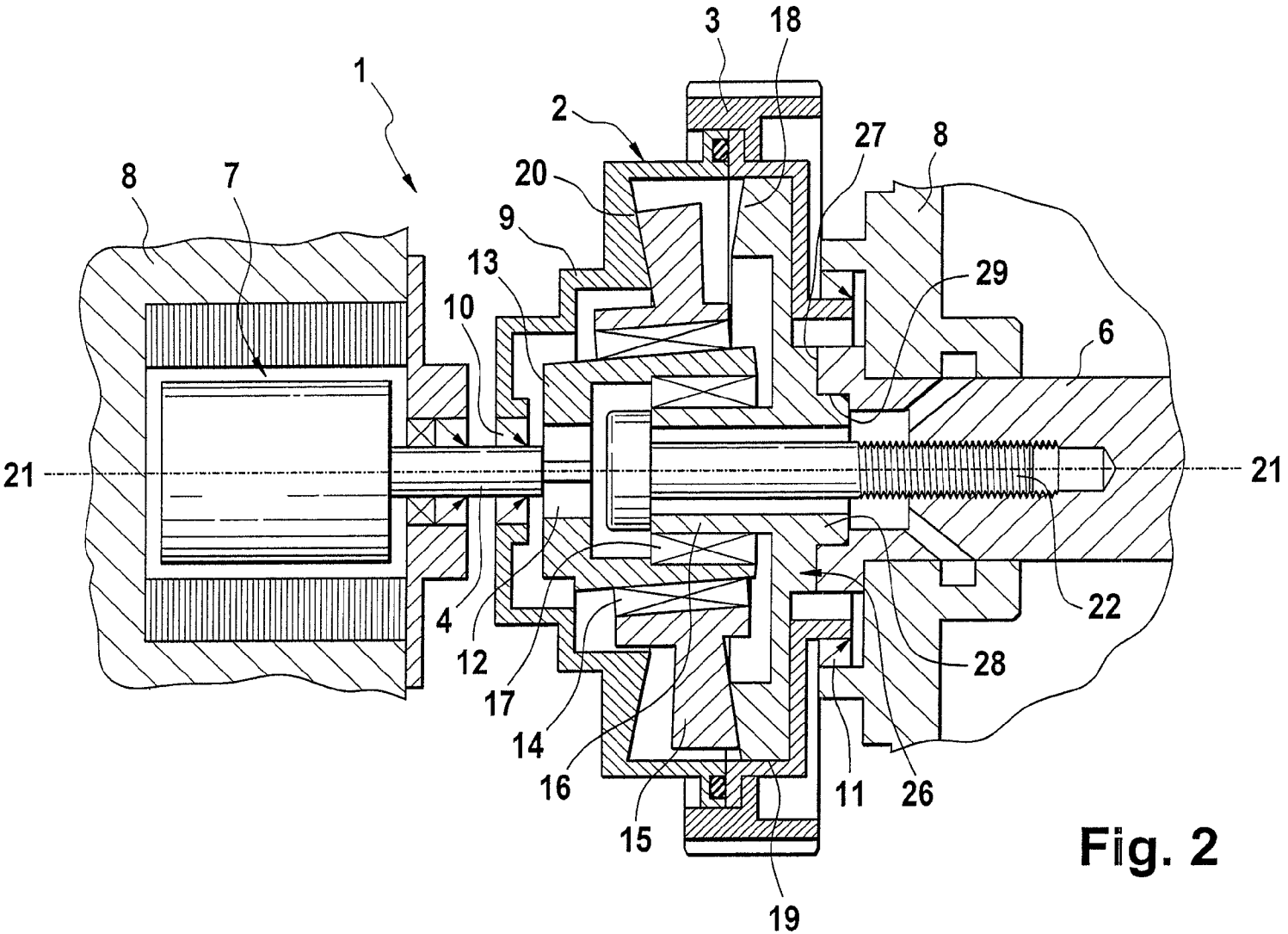

FIG. 2 shows an example configuration of a camshaft adjuster 1 with a super-position gearbox 2 in a swashplate construction. A housing 9 is connected locked in rotation with the drive gear 3 and is sealed in an axial end region by a sealing element 10 relative to the adjustment shaft 4. In the opposite axial end region, the housing 9 is sealed with a sealing element 11 relative to the cylinder head 8. An end region of the camshaft 6 projects into an interior formed by the housing 9 and the cylinder head 8. Furthermore, in the interior there are an eccentric shaft or swash shaft 13 connected to the adjustment shaft 4 by a coupling 12, a swash plate 15 supported by a bearing element 14, for example, a roller bearing, and a hollow shaft 16 that is supported by a bearing element 17, for example, a roller bearing, on the inside in a central recess of the eccentric shaft 13 and carries a driven bevel gear 18. The driven bevel gear 18 is supported by a bearing 19 relative to the housing 9. In the interior, the housing 9 forms a driving bevel gear 20. The swash plate 15 has suitable teeth on the opposite ends. The eccentric shaft 13 with the bearing element 14 and swash plate rotates about an axis inclined relative to a longitudinal axis 21-21, so that the swash plate meshes, on one side, in sub-regions offset relative to each other in the peripheral direction with the driving bevel gear 20 and, on the other side, with the driven bevel gear 18, wherein, between the driving bevel gear and the driven bevel gear, a speed-increasing or speed-decreasing ratio is given. The driven bevel gear 18 is connected locked in rotation with the camshaft 6.

For the embodiment shown in FIG. 2, the hollow shaft 16 is screwed with the driven bevel gear 18 of a central screw 22 that extends through the hollow shaft 16 screwed, on the front end, with the camshaft 6.

The super-position gearbox 2 shown in FIG. 2 in the form of a swashplate gearbox is only one example configuration of such a super-position gearbox 2. The super-position gearbox 2, however, can also involve any other super-position gearbox, see also the camshaft adjuster, planetary gearbox, or triple-shaft gearbox classified above.

In an alternative configuration, the gearbox elements creating the super-position involve, for example, an axially moving control element that is loaded by the control assembly and that interacts with a drive gear-fixed thread and a camshaft-fixed thread, cf., e.g., EP 1 403 470 A1.

Figure 3:
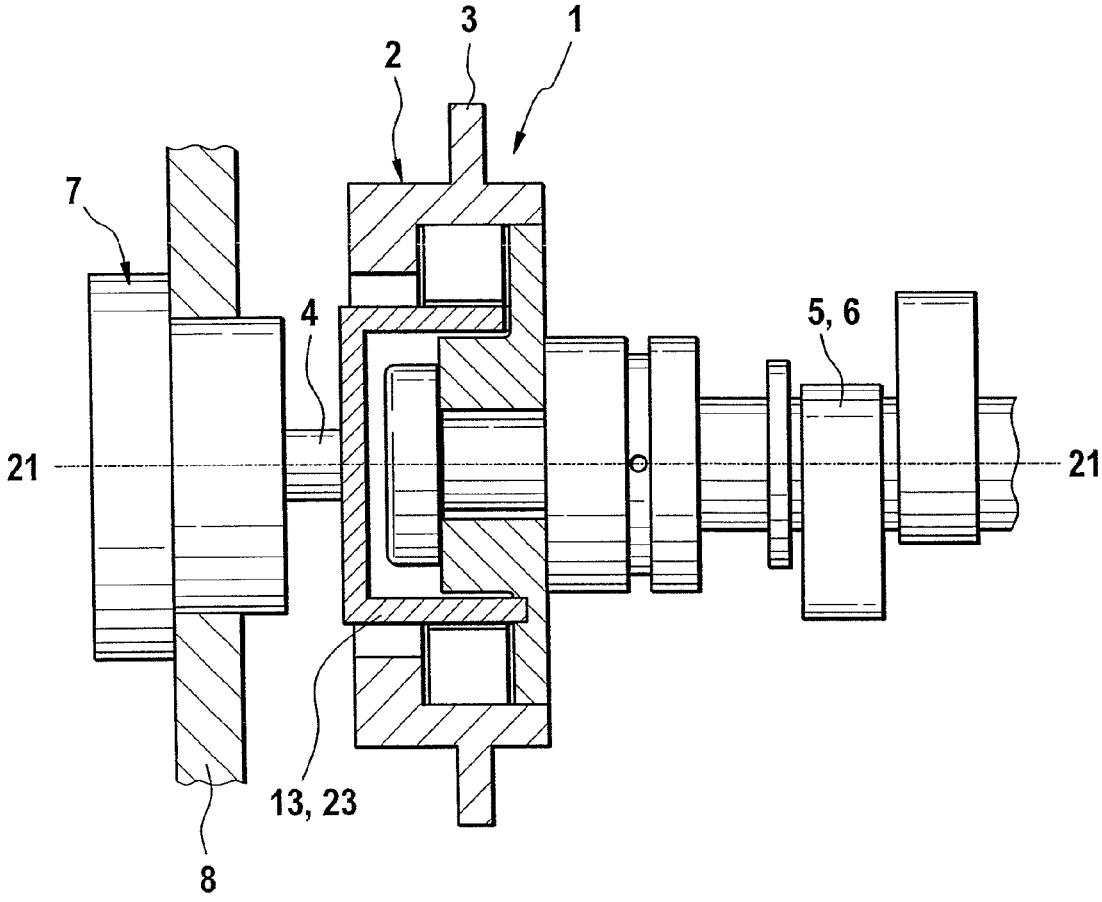

For the embodiment shown in FIG. 3, the electrical control assembly 7 is arranged on the side of the super-position gearbox 2 facing away from the camshaft 6. The electrical control assembly 7 is supported relative to the cylinder head 8. The control shaft 4 extends across an eccentric shaft 13 or a cross bar 23 into the super-position gearbox 2 and here is in driving connection with the other gear elements of the super-position gearbox 2.

Figure 4:
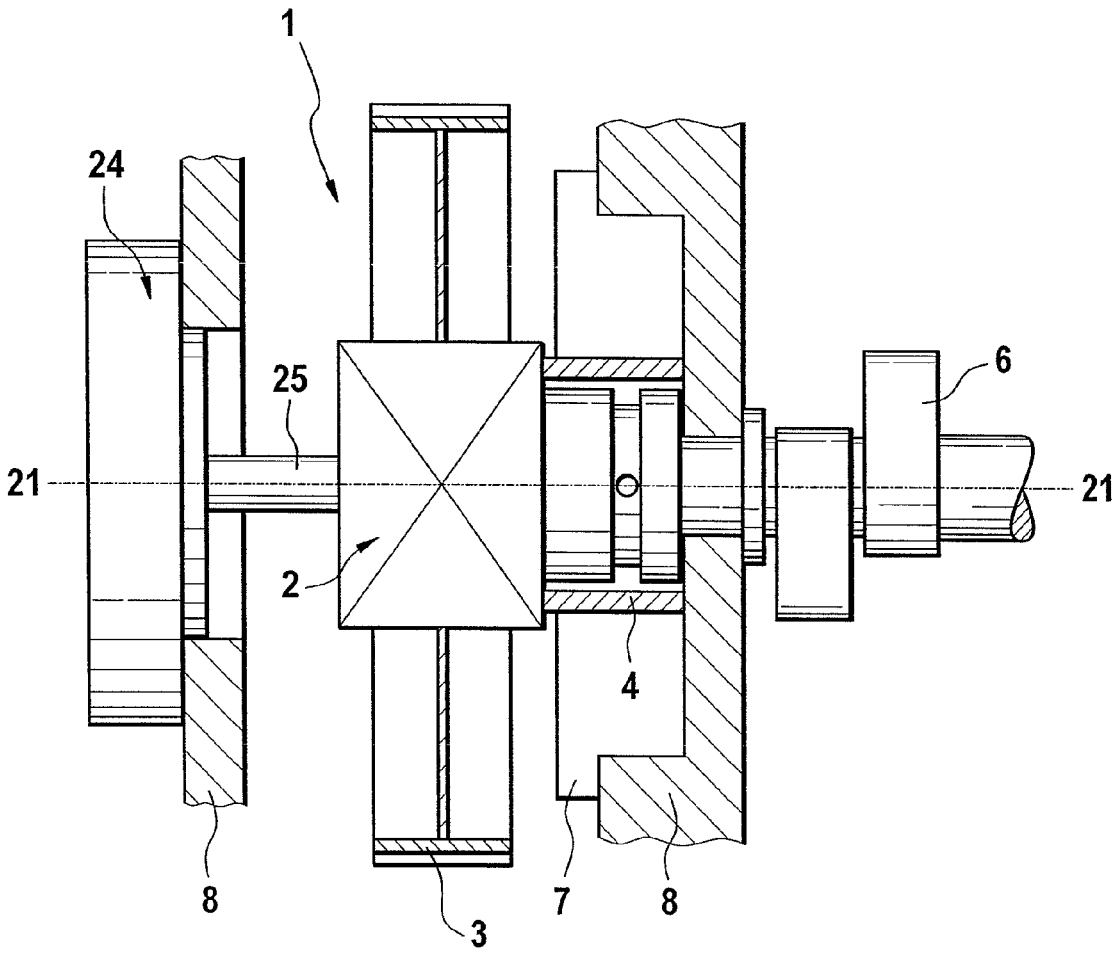

For the embodiment shown in FIG. 4, the super-position gearbox 2 is shown merely schematically. On the side of the super-position gearbox 2 facing away from the camshaft 6, an add-on assembly 24 is arranged and supported relative to the cylinder head 8. The add-on assembly 24 is connected by a drive shaft 25 arranged aligned with the longitudinal axis 21-21 with the allocated gearbox element of the super-position gearbox 2. On the side facing the camshaft 6, the electrical control assembly 7 is arranged that extends on the outside radially around the camshaft 6 and drives a hollow shaft 41 that is oriented aligned with the camshaft 6 and longitudinal axis 21-21 and that enters into the super-position gearbox 2 through a suitable recess of the super-position gearbox 2 while forming a seal and is here connected to the gearbox element allocated to the control assembly 7.

For the embodiment shown in FIG. 2, a connection or attachment of the camshaft adjuster 1 is realized in the region of a connection element 26 that has an annular surface 27 and a hollow cylinder-shaped bushing 28. The connection element 26 enters with the bushing 28 into a corresponding borehole 29 of the camshaft. When the central screw 22 is screwed into the front-end thread of the camshaft 6, the connection element 26 is tensioned between the front end of the camshaft 6 and the head of the central screw 22, wherein an annular surface 27 is pressed against the front end of the camshaft 6.

Figure 5:
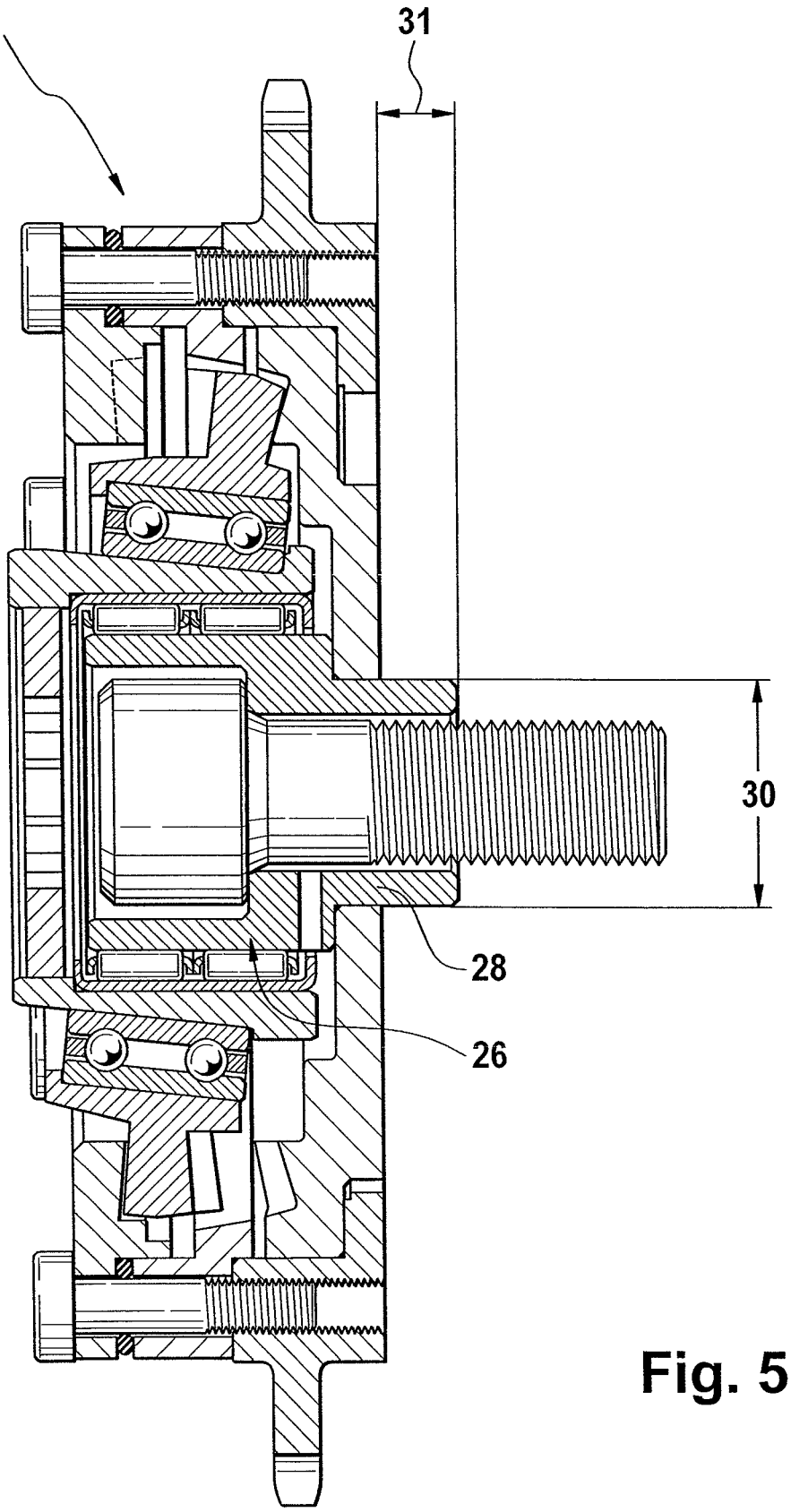

FIG. 5 shows a camshaft adjuster 1 that should be used with unchanged diameter 30 and unchanged, freely projecting length 31 of the bushing 28 in sub-groups with different camshafts 6, 6' and/or different installation conditions.

Figure 6:
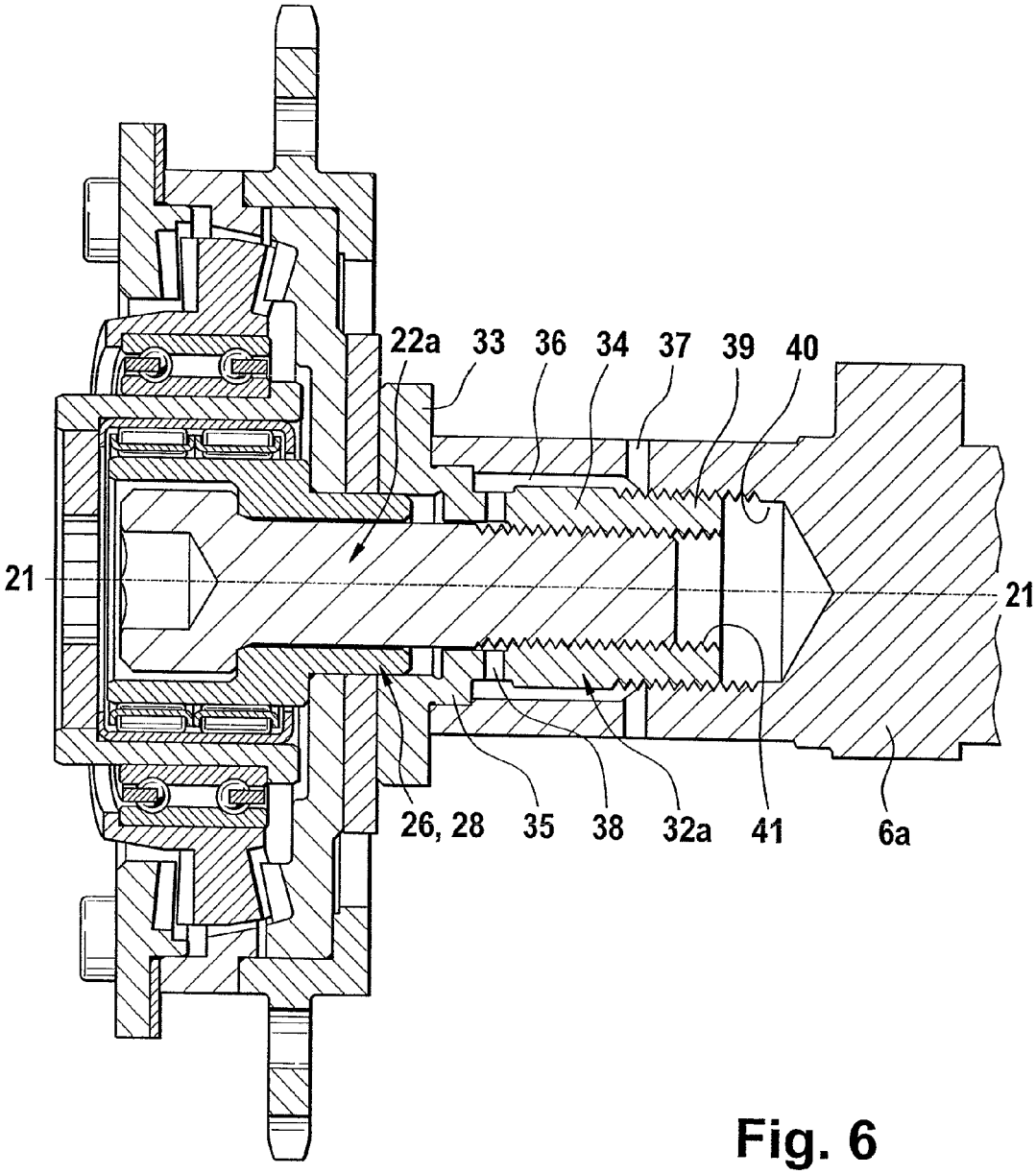

Here, as shown in FIG. 6, an adapter 32*a* is used that is connected axially between the camshaft 6*a* and the connection element 26. The adapter 32*a* has an approximately L-shaped construction in its half cross section, wherein the leg 33 oriented perpendicular to the longitudinal axis 21-21 forms an annular flange with which the adapter 32*a* contacts a counter surface of the connection element 26 or, as shown in FIG. 6, an outer surface of the camshaft adjuster 1. The other leg 34 has, in the transition region to the leg 33, a shoulder 35 with which the adapter 32*a* is held in a longitudinal recess of the camshaft 6*a* in an accurately fitting way while setting the orientation of the adapter 32*a* aligned with the longitudinal axis 21-21. In the contract region of the shoulder 35 with the camshaft 6*a*, suitable sealing elements can be provided. Adjacent to the shoulder 35, a hollow cylinder-shaped ring gap 36 by which a radial borehole 37 of the camshaft 6*a* forms a flow medium connection with a radial borehole 38 of the adapter 32*a* is constructed between the leg 34 of the adapter 32*a* and the camshaft 6*a*. A flow medium, in particular, a pressure medium and/or a lubricant, can enter into the camshaft adjuster 1 from the radial borehole 38 through suitable channels and overflow cross sections. With the end region 39 of the leg 34 supported in front of the radial borehole 37, the adapter 32*a* is held in a borehole 40 of the camshaft in an accurately fitting way or is screwed into a threaded borehole 40. For the embodiment shown in FIG. 6, the adapter 32*a* is fixed in the camshaft 6*a* independent of the central screw 22*a*. By the central screw 22*a* that is screwed into a passage thread 41 of the adapter 32*a*, then the connection element 26 is screwed centrally with the adapter 32*a*.

Different installation conditions and/or different geometries of the camshaft 6*a* can be taken into account by a modified construction of different adapters 32*a*, 32*b*, 32*c* for different sub-groups a, b, c, for example, by a different axial dimensioning of the leg 33, whereby a distance between the front end of the camshaft 6*a* and the camshaft adjuster 1 can be adapted.

Figure 7:
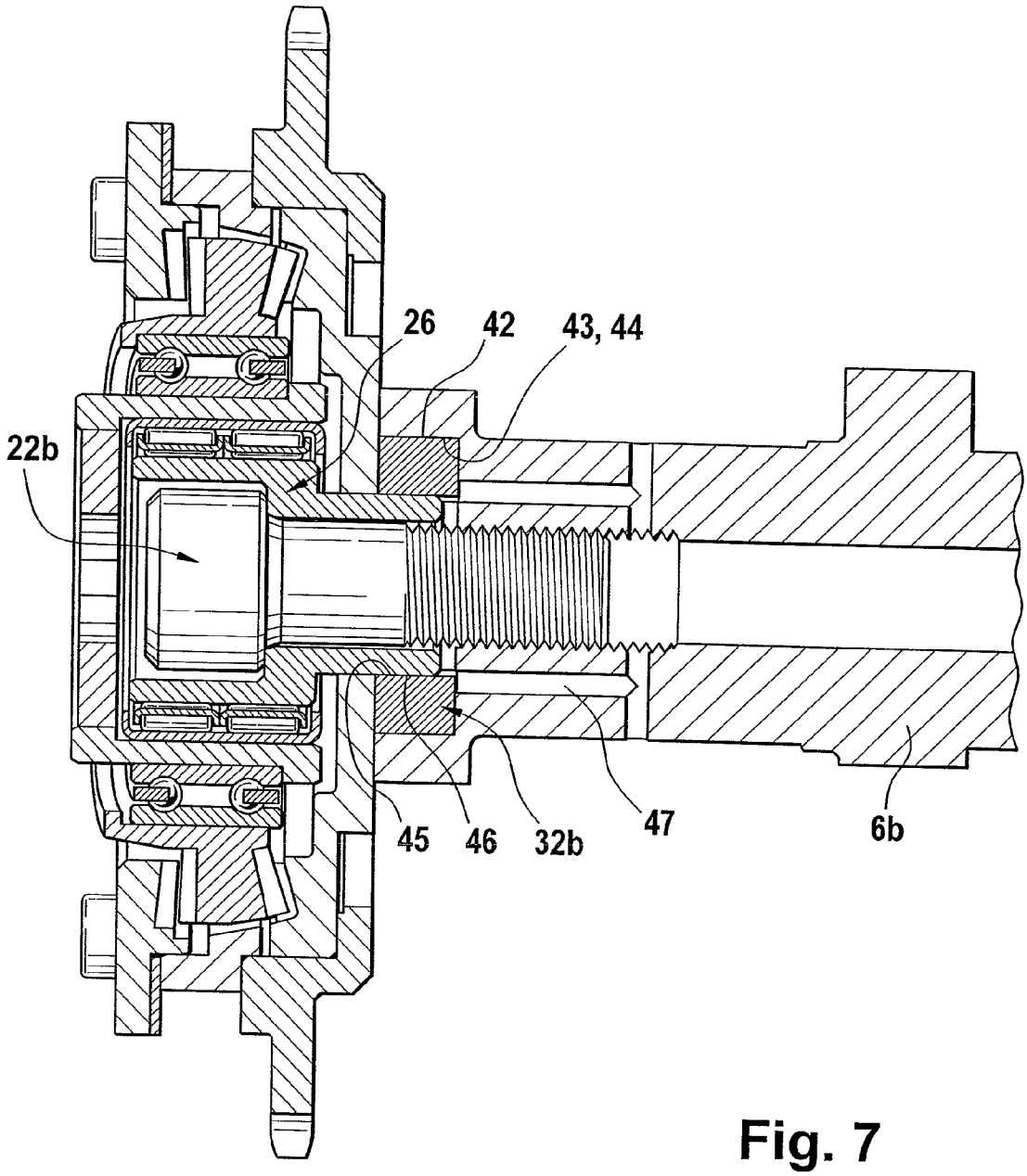

For the embodiment b shown in FIG. 7, deviating from FIG. 6, the central screw 22*b* is screwed directly on the front end and centrally into a corresponding thread of the camshaft 6*b*. In this case, the adapter 32*b* has a rectangular or square half cross section and is held with its outer lateral surface 42 in an accurately fitting way in an inner lateral surface 43 of a front end borehole 44 of the camshaft 6*b*. On an inner lateral surface 45 of the adapter 32*b*, an outer lateral surface 46 of the connection element 26 is supported in an accurately fitting way. The front ends of the adapter 32*b* contact an outer surface of the camshaft adjuster 32 and also the base of the borehole 44 of the camshaft 6*b* for pretensioning given by the central screw 22*b* on the flow channels 47 that are here oriented in the axial direction, opening into flow channels that are formed in the adapter 32*b* and/or between the adapter 32*b*, connection element 26, and/or camshaft 6*b*, whereby, for example, flow medium is allowed to overflow to the camshaft adjuster 1.

Figure 8:
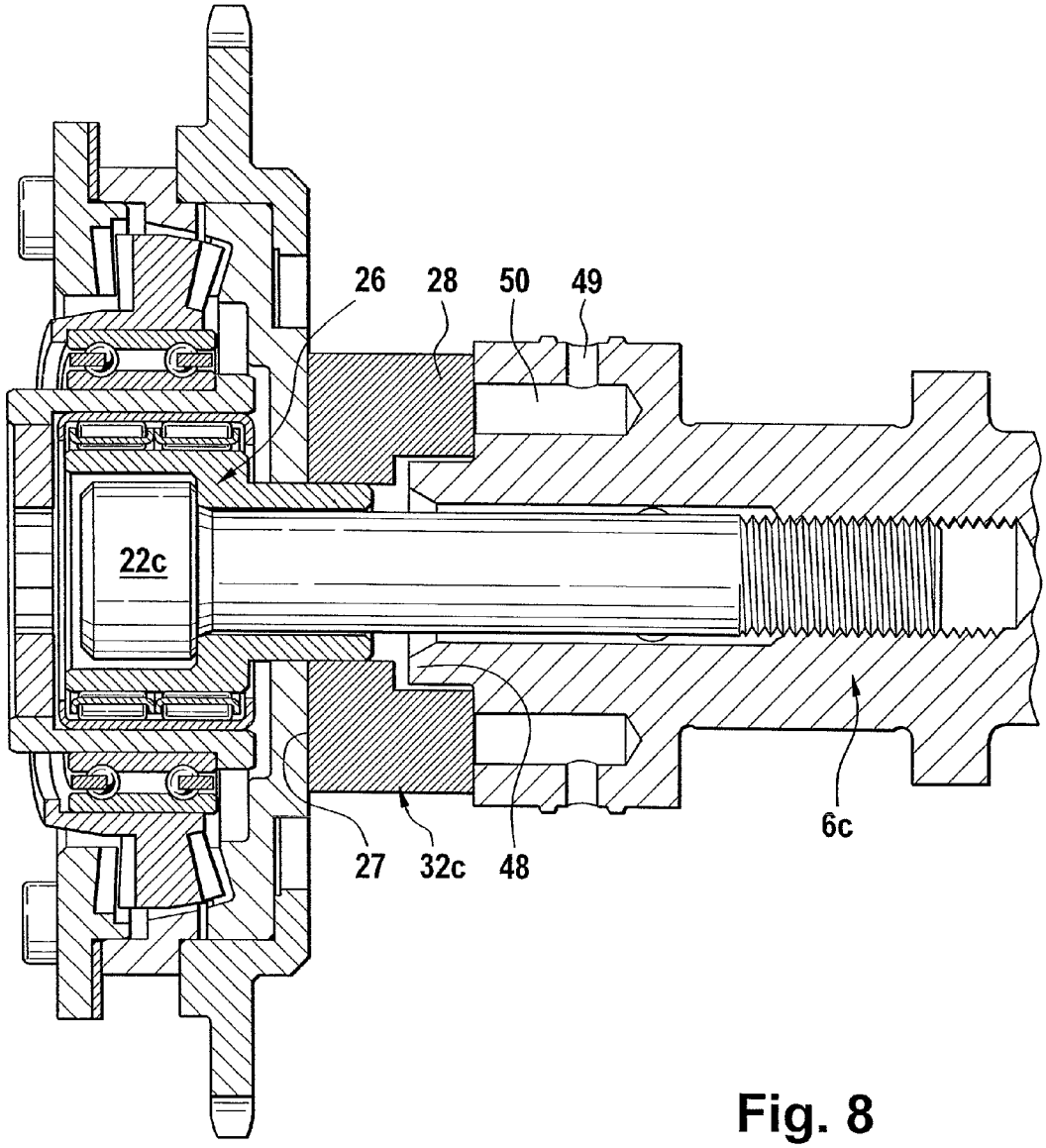

FIG. 8 shows another embodiment c for which the adapter 32*c* is formed with an annular surface 27 that carries the bushing 28 on the outside radially on the side facing the camshaft 6*c*. In this case, an inner lateral surface of the annular surface 27 is supported on the outer lateral surface of the connection element 26, while an inner lateral surface of the bushing 28 holds, in an accurately fitting way, a front-end projection 48 of the camshaft 6*c*. The front ends of the adapter 32*c* are loaded by the central screw 22*c* between the camshaft 6*c* and the camshaft adjuster 1. Through such tensioning, the contact region between the adapter 32 and camshaft adjuster 1 and camshaft 6 can be sealed radially outwardly, wherein on the inside radially from the adapter 32*c*, a hollow chamber can be formed by which, for example, a flow medium can be exchanged between the camshaft 6*c* and the camshaft adjuster 1. For the embodiment shown in FIG. 8, the camshaft 6*c* has, in the region bordering the adapter 32*c*, a shoulder by which flow medium can overflow, for example, from a not-shown cylinder head with an annular groove to a radial borehole 49 that opens into a front-end axial borehole 50 from which the flow medium can be fed to the camshaft adjuster 1 under the cooperation of the adapter 32*c*.

In FIGS. 6 to 8, the same camshaft adjusters 1 according to FIG. 5 are used with identical connection dimensions (diameter 30, length 31), although, on one side, the geometries of the camshafts 6, 6*b*, 6*c* in the FIGS. 6 to 8 are very different and also the distance of the front ends of the camshafts 6*a*, 6*b*, 6*c* from the camshaft adjuster 1 is very different. Likewise, the control of the flow medium between the camshaft 6*a*, 6*b*, 6*c* and camshaft adjuster 1 is very different in FIGS. 6 to 8. The embodiments shown in FIGS. 6 to 8 each represent a sub-group in the sense of the invention that can be combined into a group according to the invention with the use of a common, structurally identical camshaft adjuster, such that for the adaptation, different adapters 32*a*, 32*b*, 32*c* can be used.

Figure 9:
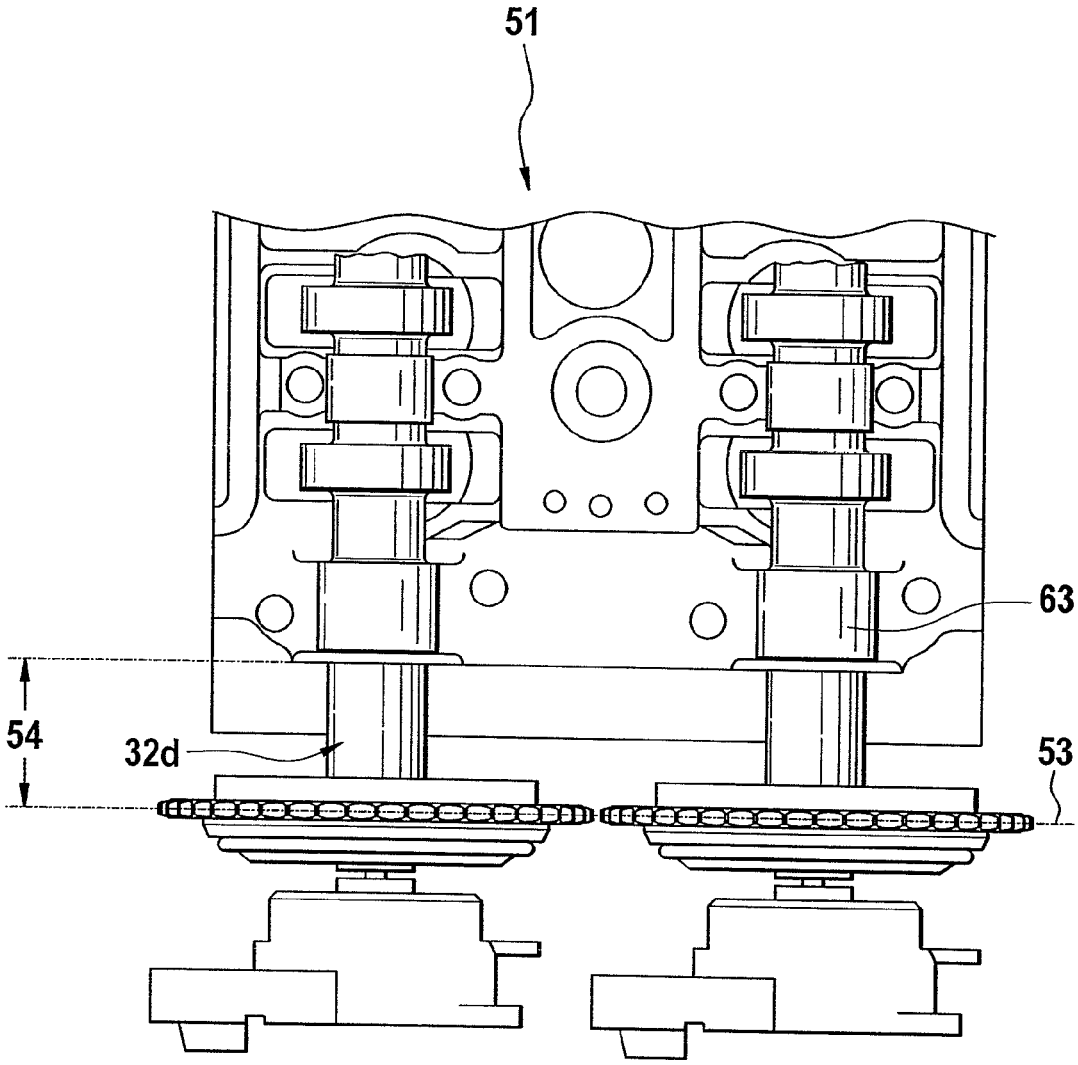
Figure 10:
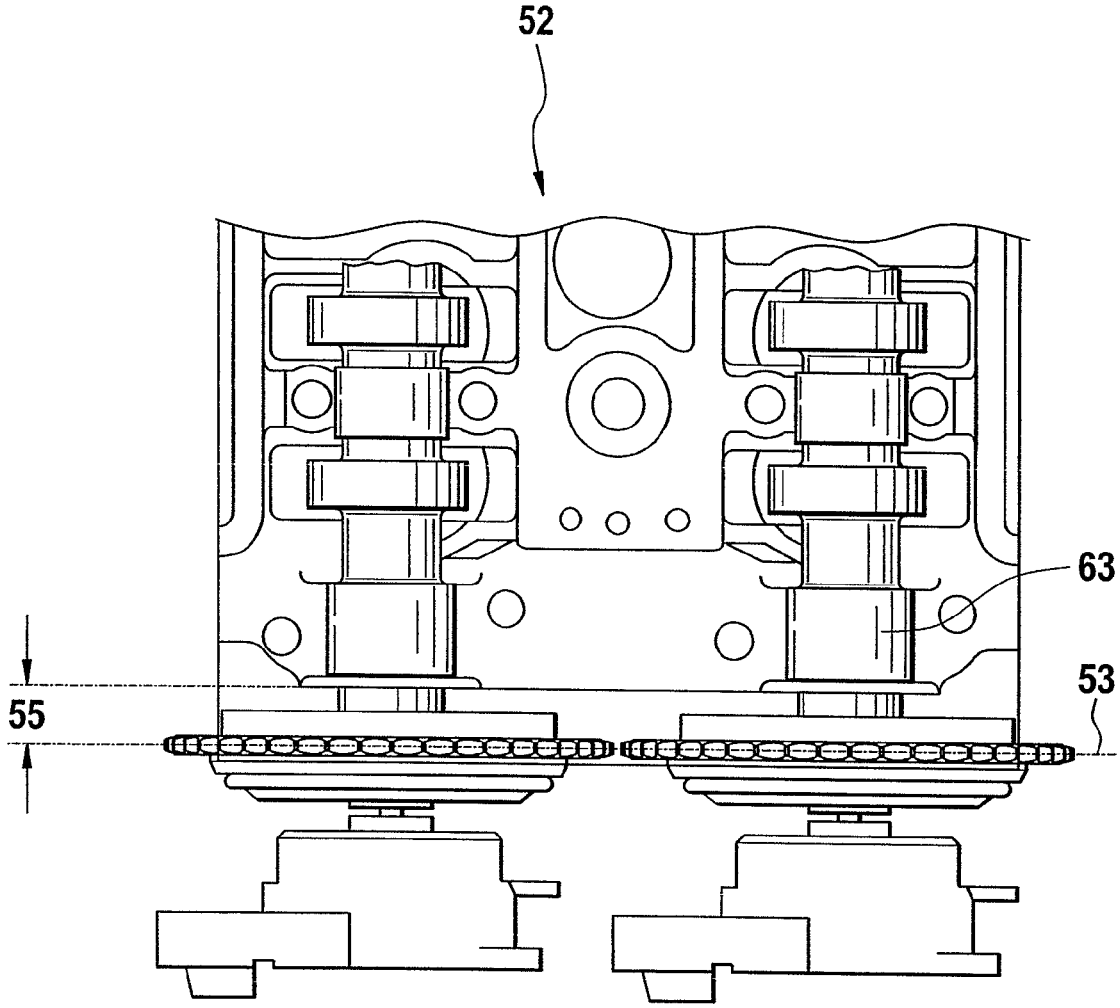

While FIG. 9 shows the installation relationships for a right cylinder bank 51, in FIG. 10 the installation situation for a left cylinder bank 52 is shown. While the position of a common chain track 53 for the right cylinder bank 51 and the left cylinder bank 52 is naturally the same, for the right cylinder bank 51, a distance 54 of the chain track 53 from a front end of the camshafts or a first camshaft bearing 63 that is greater than the corresponding distance 55 for the left cylinder bank 52 is produced. Such differing distances are taken into account through the use of different adapters 32*d* in the cylinder banks 51, 52, wherein for the left cylinder bank 52 with the smaller distance, the use of an adapter 32 can also be completely eliminated. Such a solution is useful especially for internal combustion engines with several cylinder banks and also with separate control drives. For example, for V-engines, the right and left cylinder banks are arranged offset relative to each other. Depending on the design of the control drive, in a few cases, different distances are also produced between a first camshaft bearing and the position of the chain track. In such a case, the adapter 32 is constructed as an "intermediate piece."

Figure 11:
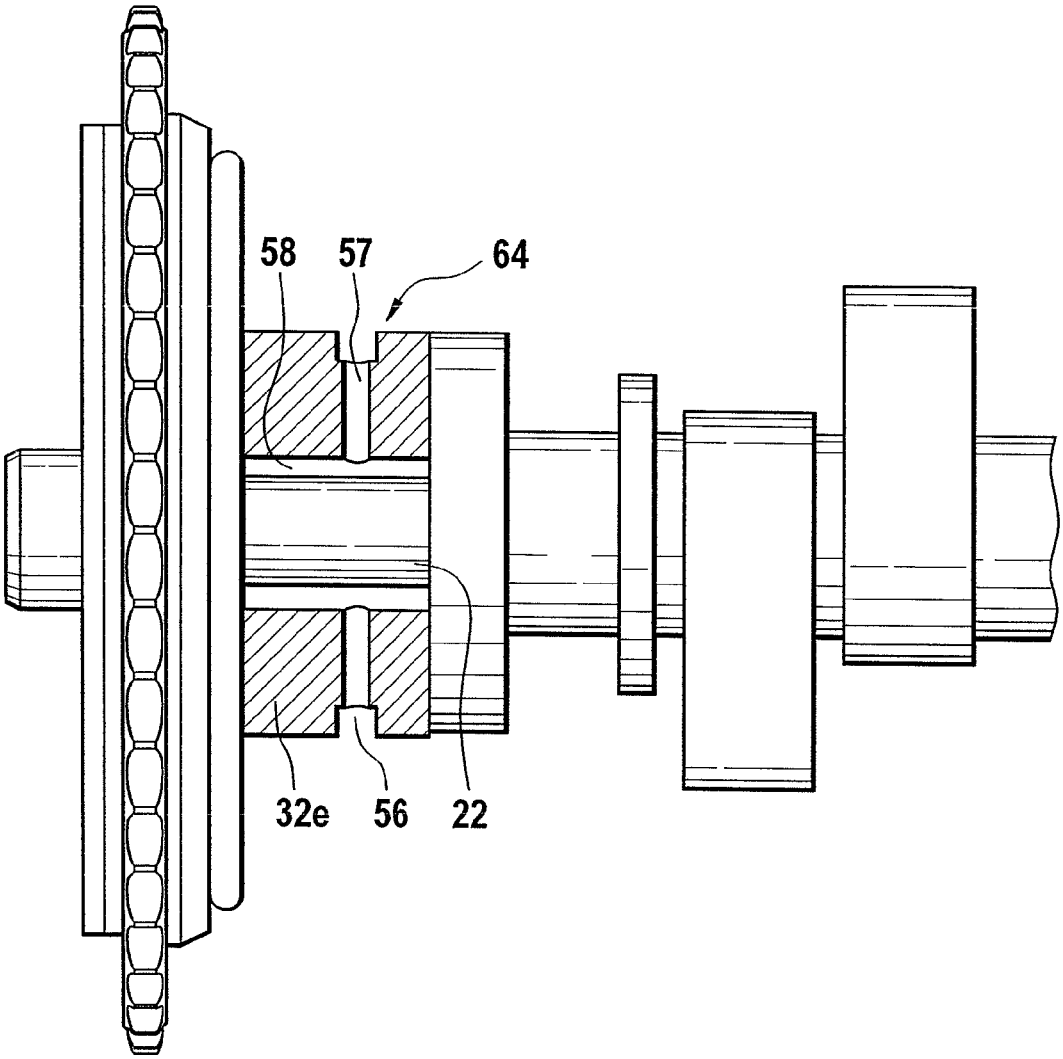

FIG. 11 shows the use of an adapter 32*e* with another function, namely as a rotary connection 64 for a flow medium. For this purpose, the adapter 32*e* has a peripheral groove 56 on the outside radially. A radial borehole of the adapter 32*e* by which the flow medium can overflow from the groove 56 into the interior of the adapter 32*e* opens into the groove 56, where a peripheral intermediate space 58 is formed between the adapter 32*e* and central screw 22. In this way, the camshaft adjuster 1 can be controlled for a construction as a hydraulic camshaft adjuster or alternatively or additionally oil can be supplied.

Figure 12:
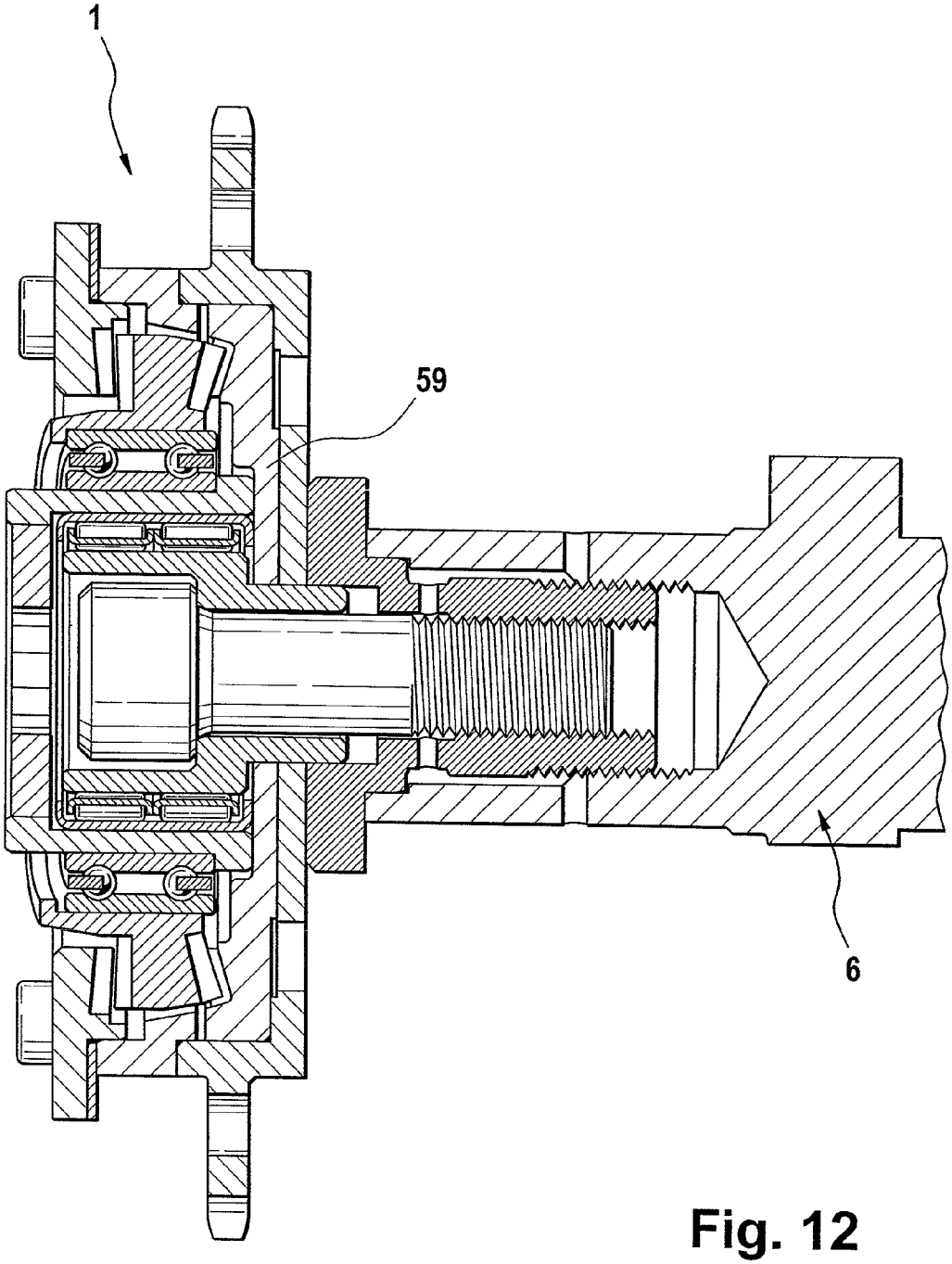
Figure 13:
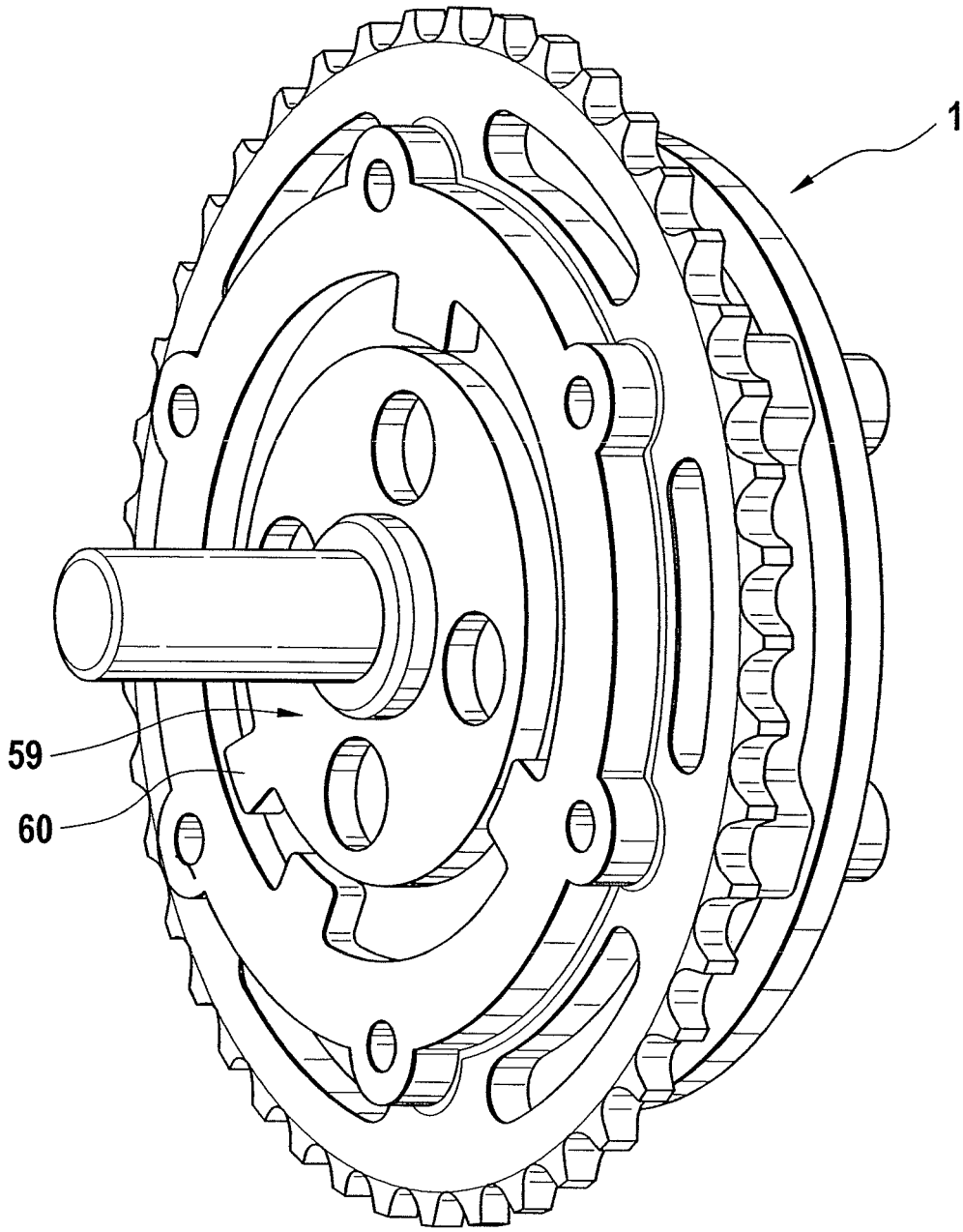

FIGS. 12 and 13 show possibilities for an adaptation of basically structurally identical camshaft adjusters 1 for the case that these should permit different operating positions for different sub-groups. According to this proposal of the invention, in the different camshaft adjusters 1, different positioning elements can be used. For the shown embodiment, the positioning element involves a stop ring 59 with a stop 60 on which a rotor or stator contacts in one end position. Through an exchange of the stop ring 59 for camshaft adjusters of different sub-groups, a simple adaptation of the operating positions and end positions can be performed.

Figure 14:
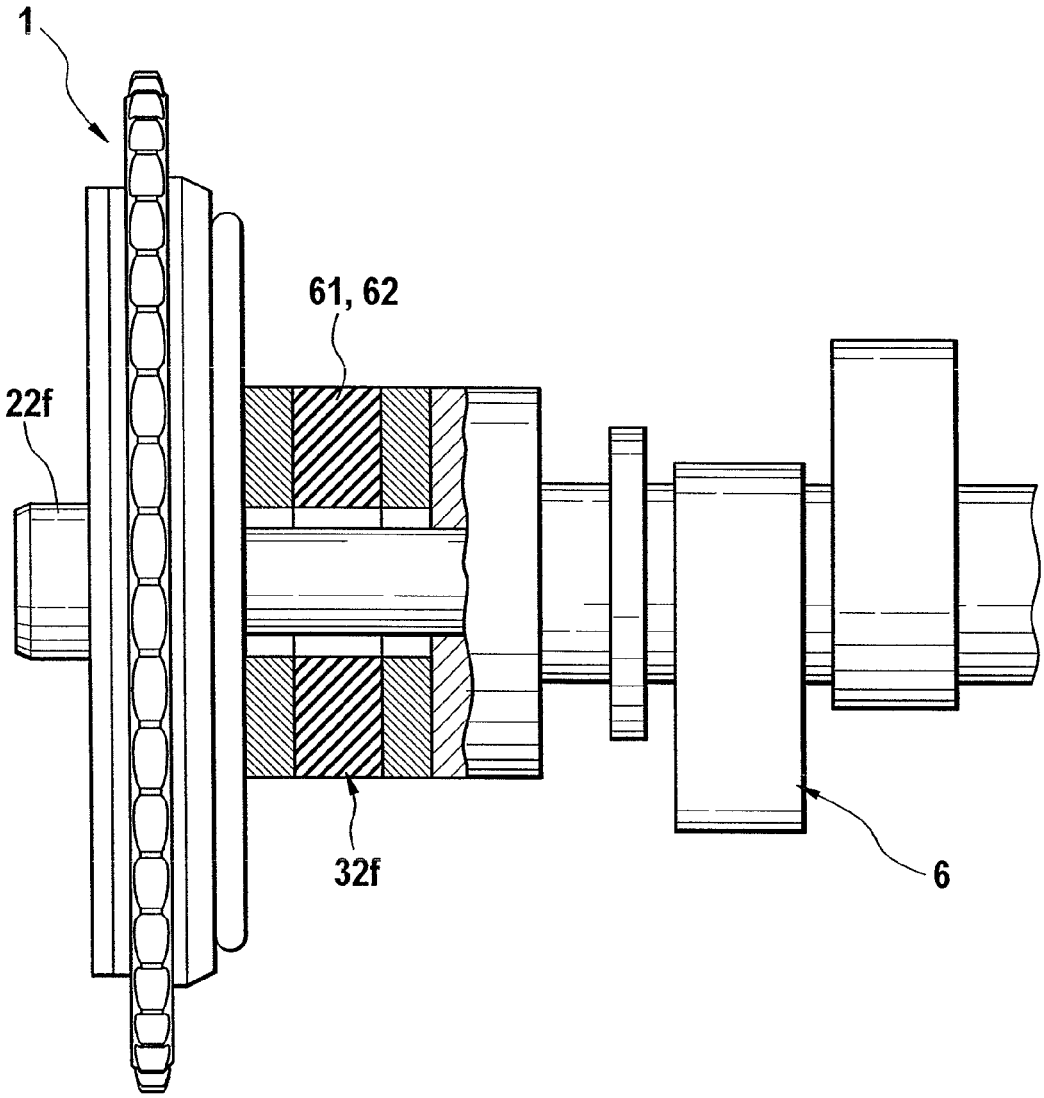

For the embodiment shown in FIG. 14, the adapter 32*f* is equipped with an integrated spring element 61 and/or damping element 62. For example, such a spring element 61 and/or damping element 62 involves an elastomer element vulcanized between metal disks. Through the use of such elements 61, 62, a transmission of forces, moments, and rotating oscillations between the camshaft and camshaft adjuster can be influenced.

The adapter 32 can be coated or can have a special surface structure that can be used for producing a microscopic positive-fit connection to adjacent components. For example, a disk-shaped adapter 32 can be reshaped relatively easily and hardened in comparison with such processing of a camshaft or components of the camshaft adjuster.

It is also conceivable that a connection is realized in which there is no centering borehole, but instead there is a sleeve that is placed on the gearbox of the camshaft adjuster and that holds and centers a ring by which a control assembly is then, in turn, centered.

LIST OF REFERENCE SYMBOLS

1 Camshaft adjuster
2 Super-position gearbox
3 Drive gear
4 Control shaft
5 Driven shaft
6 Camshaft
7 Control assembly
8 Cylinder head
9 Housing
10 Sealing element
11 Sealing element
12 Coupling
13 Eccentric shaft
14 Bearing element
15 Swash plate
16 Hollow shaft
17 Bearing element
18 Driven bevel gear

19 Bearing
20 Drive bevel gear
21 Longitudinal axis
22 Central screw
23 Cross bar
24 Add-on assembly
25 Drive shaft
26 Connection element
27 Annular surface
28 Bushing
29 Borehole
30 Diameter
31 Length
32 Adapter
33 Leg
34 Leg
35 Shoulder
36 Annular gap
37 Radial borehole
38 Radial borehole
39 End region
40 Borehole
41 Passage thread
42 Outer lateral surface
43 Inner lateral surface
44 Borehole
45 Inner lateral surface
46 Outer lateral surface
47 Flow channel
48 Projection
49 Radial borehole
50 Axial borehole
51 Right cylinder bank
52 Left cylinder bank
53 Chain track
54 Distance
55 Distance
56 Groove
57 Radial borehole
58 Intermediate space
59 Stop ring
60 Stop
61 Spring element
62 Damping element
63 Camshaft bearing
64 Rotary connection

The invention claimed is:

1. An assembly comprising camshafts and camshaft adjusters in an internal combustion engine, the camshafts having different end connection configurations that are each adapted to be in driven connection with a respective one of the camshaft adjusters, the camshaft adjusters are structurally identical and each have a structurally defined connection element and different adapters are located between the connection element and the respective camshaft end configurations to connect the selected camshaft to the selected camshaft adjuster, wherein the camshaft adjusters are each allocated to a cylinder bank of the internal combustion engine and the adapters compensate different distances between a first camshaft bearing of the respective camshaft and a position of a chain track.

2. A camshaft adjuster and camshaft assembly, comprising a camshaft having a camshaft end configuration for connection to a camshaft adjuster, the camshaft adjuster including a connection element, and an adapter located between the connection element and the camshaft and connected to a restoring spring that includes an elastomer element vulcanized between metal disks.

3. The assembly according to claim 1, wherein at least one of the camshafts and the associated connection element of the respective camshaft adjuster are supported by centering surfaces directly against each other.

4. The assembly according to claim 1, wherein at least one of the adapters defines a flow channel.

5. The assembly according to claim 1, wherein at least one of the camshafts and the respective connection element are coupled with each other by at least one screw.

6. The assembly according to claim 1, wherein at least one of the adapters is constructed as a rotary connection for a lubricant or a pressure medium.

7. The assembly according to claim 1, wherein in at least one of the camshaft adjusters, different positioning elements are used to set defined operating positions of the camshaft adjuster.

8. The assembly according to claim 1, wherein a rotational angle transmitter is integrated into at least one of the adapters.

9. The assembly according to claim 1, wherein fail-safe elements are integrated into at least one of the adapters.

10. The assembly according to claim 1, wherein the camshafts of the cylinder bank are coupled with different camshaft adjusters by different adapters.

11. The assembly according to claim 1, wherein at least one of the adapters has a limiting element that interacts with a counter element connected to a stator for limiting an adjustment range of the respective camshaft adjuster.

12. The assembly according to claim 1, wherein a support is provided by a bearing for supporting at least one of the camshafts by the respective adapter.

13. The assembly according to claim 1, wherein at least one of the adapters is connected to a restoring spring.

14. The assembly according to claim 1, wherein add-on assemblies are connected by at least one of the adapters.

* * * * *